US006923238B2

(12) United States Patent
Kern et al.

(10) Patent No.: US 6,923,238 B2
(45) Date of Patent: Aug. 2, 2005

(54) MULTI-PANEL DOOR WITH AN AUXILIARY DRIVE MECHANISM

(75) Inventors: Rodney Kern, Dubuque, IA (US); James Schwingle, Cuba City, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 10/054,454

(22) Filed: Nov. 13, 2001

(65) Prior Publication Data

US 2002/0062932 A1 May 30, 2002

Related U.S. Application Data

(63) Continuation of application No. 09/394,799, filed on Sep. 10, 1999, now Pat. No. 6,352,097.

(51) Int. Cl.[7] ..... E05D 15/06

(52) U.S. Cl. ..... 160/197; 160/118; 160/202; 160/222; 49/102

(58) Field of Search ..... 160/117, 118, 160/119, 214, 222, 223, 224, 225, 197, 200, 202; 49/102, 120, 121, 122, 123

(56) References Cited

U.S. PATENT DOCUMENTS

| | | | | |
|---|---|---|---|---|
| 643,307 A | | 2/1900 | Schmitt | 160/197 |
| 770,827 A | * | 9/1904 | Sexton | 160/118 |
| 843,011 A | | 2/1907 | Hale et al. | 160/190 |
| 1,220,910 A | | 3/1917 | Toll | 160/190 |
| 1,245,882 A | | 11/1917 | Davis | 49/102 |
| 1,406,951 A | | 2/1922 | Fehr | |
| 1,439,373 A | | 12/1922 | Norwood et al. | 160/224 |
| 1,534,210 A | | 4/1925 | Griffith et al. | 49/102 |
| 1,681,545 A | | 8/1928 | Lang | 49/102 |

(Continued)

FOREIGN PATENT DOCUMENTS

| | | |
|---|---|---|
| DE | 573632 | 3/1933 |
| EP | 0 478 938 A1 | 8/1991 |
| FR | 980.892 | 5/1951 |
| FR | 2315-598 | 6/1975 |
| FR | 2582-343 | 5/1985 |
| GB | 2 219 618 | 12/1989 |
| JP | 5-118180 | 5/1993 |
| JP | 6-72681 | 3/1994 |
| JP | 6032572 | 5/1994 |

OTHER PUBLICATIONS

*Jamison Sound Reduction, Special Purpose, Cold Storage Doors* brochure, Jamison Door Company, 1998, 8 pages.
*Introducing The SST Smooth Operator System* brochure, Therm–L–Tec Systems, Inc., 6 pages.

*Primary Examiner*—Blair M. Johnson
(74) *Attorney, Agent, or Firm*—Marshall, Gerstein & Borun LLP

(57) ABSTRACT

A multi-panel sliding door includes a main drive to directly move a leading door panel and includes an auxiliary drive to smoothly accelerate a lagging door panel. In some embodiments, the auxiliary drive includes a hanging weight that urges the lagging panel to its open position. In another embodiment, the auxiliary drive includes a belt and sheave arrangement attached to the lagging panel. The leading panel is coupled to move the belt around two sheaves as the leading panel moves relative to the lagging one. The belt's movement is limited by a bumper that is attached to one point on the belt and is constrained to travel between one of the sheaves and a fixed stop attached to a wall or the track. As the main drive starts moving the leading panel to its open position, the relative movement between the two panels causes the belt to move the bumper up against the fixed stop. From there, continued opening movement of the leading panel continues rotating the belt around the sheaves. Since the bumper now holds a portion of the belt fixed relative to the stop, the sheaves begin to translate. This begins moving the lagging panel to its open position off to one side of a doorway before the lead panel reaches its open position in front of the lagging panel.

24 Claims, 7 Drawing Sheets

U.S. PATENT DOCUMENTS

| | | | | | |
|---|---|---|---|---|---|
| 1,960,860 | A | | 5/1934 | Allen | 160/197 |
| 2,196,591 | A | * | 4/1940 | Kramer | 160/114 |
| 2,373,023 | A | | 4/1945 | Goodwin | 49/102 |
| 2,425,016 | A | | 8/1947 | Weaver | 49/102 |
| 2,517,713 | A | | 8/1950 | Rissler | 187/31 |
| 3,065,826 | A | | 11/1962 | Tucker, Jr. | 187/52 |
| 3,074,124 | A | | 1/1963 | Bergstedt | 20/19 |
| 3,425,162 | A | | 2/1969 | Halpern | 49/125 |
| 3,529,382 | A | | 9/1970 | Salvarola | 160/197 |
| 3,734,238 | A | | 5/1973 | Secresty et al. | 187/1 |
| 3,805,450 | A | | 4/1974 | Forcina | 49/231 |
| 3,807,480 | A | | 4/1974 | Smart | 160/1 |
| 3,817,161 | A | | 6/1974 | Koplon | 98/39 |
| 3,912,049 | A | | 10/1975 | Holland et al. | 187/61 |
| 4,058,191 | A | | 11/1977 | Balbo | 187/1 |
| 4,115,953 | A | | 9/1978 | Brosenius | 49/125 |
| 4,218,104 | A | | 8/1980 | Anderson et al. | 312/214 |
| 4,404,770 | A | | 9/1983 | Markus | 49/235 |
| 4,592,270 | A | | 6/1986 | Vener | 98/39 |
| 4,637,176 | A | | 1/1987 | Acock, Jr. | 52/30 |
| 4,651,469 | A | | 3/1987 | Ngian et al. | 49/233 |
| 4,735,293 | A | | 4/1988 | Everhart et al. | 187/56 |
| 4,758,299 | A | | 7/1988 | Burke | 156/313 |
| 4,957,600 | A | * | 9/1990 | Carlson et al. | |
| 4,961,454 | A | | 10/1990 | Reilly, Jr. et al. | 160/344 |
| 4,987,638 | A | | 1/1991 | Ribaudo | 16/89 |
| 5,080,950 | A | | 1/1992 | Burke | 428/81 |
| 5,083,639 | A | | 1/1992 | Kappeler | 187/51 |
| 5,165,142 | A | | 11/1992 | Pilsbury | 16/90 |
| 5,195,594 | A | | 3/1993 | Allen et al. | 169/48 |
| 5,305,855 | A | | 4/1994 | Rivera et al. | 187/56 |
| 5,383,510 | A | | 1/1995 | Allen | 160/310 |
| 5,427,205 | A | | 6/1995 | Saillio et al. | 187/334 |
| 5,899,303 | A | | 5/1999 | Allen | 187/333 |
| 6,352,097 | B1 | * | 3/2002 | Kern et al. | |

* cited by examiner

MULTI-PANEL DOOR WITH AN AUXILIARY DRIVE MECHANISM

RELATED APPLICATION

This patent is a continuation of U.S. application Ser. No. 09/394,799, filed Sep. 10, 1999, now U.S. Pat. No. 6,352,097.

FIELD OF THE INVENTION

The subject invention generally pertains to what is known as a multi-panel sliding door and more specifically to an actuator for such a door.

DESCRIPTION OF RELATED ART

So-called multi-panel sliding doors include two or more generally parallel door panels that are suspended by carriages that slide or roll along an overhead track. The carriages allow the door panels to travel in a generally horizontal direction in front of a doorway to open and close the door. When the door is open, the door panels generally overlay each other at one side of the doorway. To close the door, the panels slide out from behind each other to move in front of the doorway. When fully extended, the panels cover a span that approaches the sum of their individual widths. Applying such an arrangement to both sides of the doorway provides a bi-parting door with multiple panels on each side. In which case, leading panels (i.e., those first to pass in front of the doorway) from each side meet at generally the center of the doorway when the door closes.

With multi-panel sliding doors, the horizontal translation of a leading door panel is usually powered by a drive unit, while one or more lagging panels are pulled back and forth into position indirectly by somehow being coupled to the driven movement of the leading panel. To do this, often a vertical edge seal, strap or some other coupling connects a lagging panel to a leading one. As the leading panel is driven to move away from the center of the doorway to open the door, the lagging panel may remain stationary in front of the doorway until the leading panel has moved to where it overlays at least most of the lagging one. At this point the leading panel begins pulling the lagging one along with it to one side of the doorway in response to the coupling engaging or tightening rather suddenly. Due to the inertia of the lagging panel, the sudden action of the coupling creates a reaction comparable to that of an impact between the two panels. A similar mechanism may also be employed to pull the lag panel to the closed position.

The impact-like reaction strains the coupling and the points at which the coupling attaches to the panels. This can damage various components of the door or shorten the door's overall useful life. The impact effect also places a sudden inertial load on the drive unit, which slows the opening of the door.

For doors that are designed to open automatically in the presence of an approaching vehicle, such as a forklift, a slow opening door is susceptible to being struck by a fast moving vehicle. Moreover, a closed door limits a driver's visibility to only what is in front of the door. The nature of the impact can also lead to a jerky, unsmooth door operation, particularly if the lag panel is freely moveable. Moreover, with a free lag panel, it may be difficult to accurately maintain the lag panel in a desired open or closed position, since it may be subject to drift when not directly engaged by or coupled to the lead panel

SUMMARY OF THE INVENTION

To assist in providing smooth door operation and reliable positioning of a lag panel in a multi-panel sliding door, an auxiliary drive is used to move the lag panel.

In some embodiments of a multi-panel sliding door, a primary drive unit moves one panel while an auxiliary drive mechanism that includes a suspended weight moves another panel.

In some embodiments, a primary drive unit moves one panel directly, while moving another panel indirectly by way of an auxiliary drive mechanism that includes a belt, chain or some other flexible ring encircling two rotatable members such as a sheave, sprocket or some other type of wheel, the auxiliary drive being coupled to the driven panel.

In some embodiments, a drive mechanism that includes a belt, chain or some other flexible ring encircling two rotatable members such as a sheave, sprocket or some other type of wheel, also includes a bumper that is attached to the ring and engageable with a stop, wherein the position of the bumper can be varied to allow door panels of a given width to accommodate doorways of different widths.

In some embodiments, a lead and lag panel have a first state where one panel moves independently of the other, and a second state where movement of one panel is dependent on movement of the other panel, with the panels moving at different speeds.

In still other embodiments, lead and lag panels are coupled for movement with a constant speed differential between panels sometime during movement of the panels to an open position.

DESCRIPTION OF THE PREFERRED EMBODIMENTS

Figure 1:
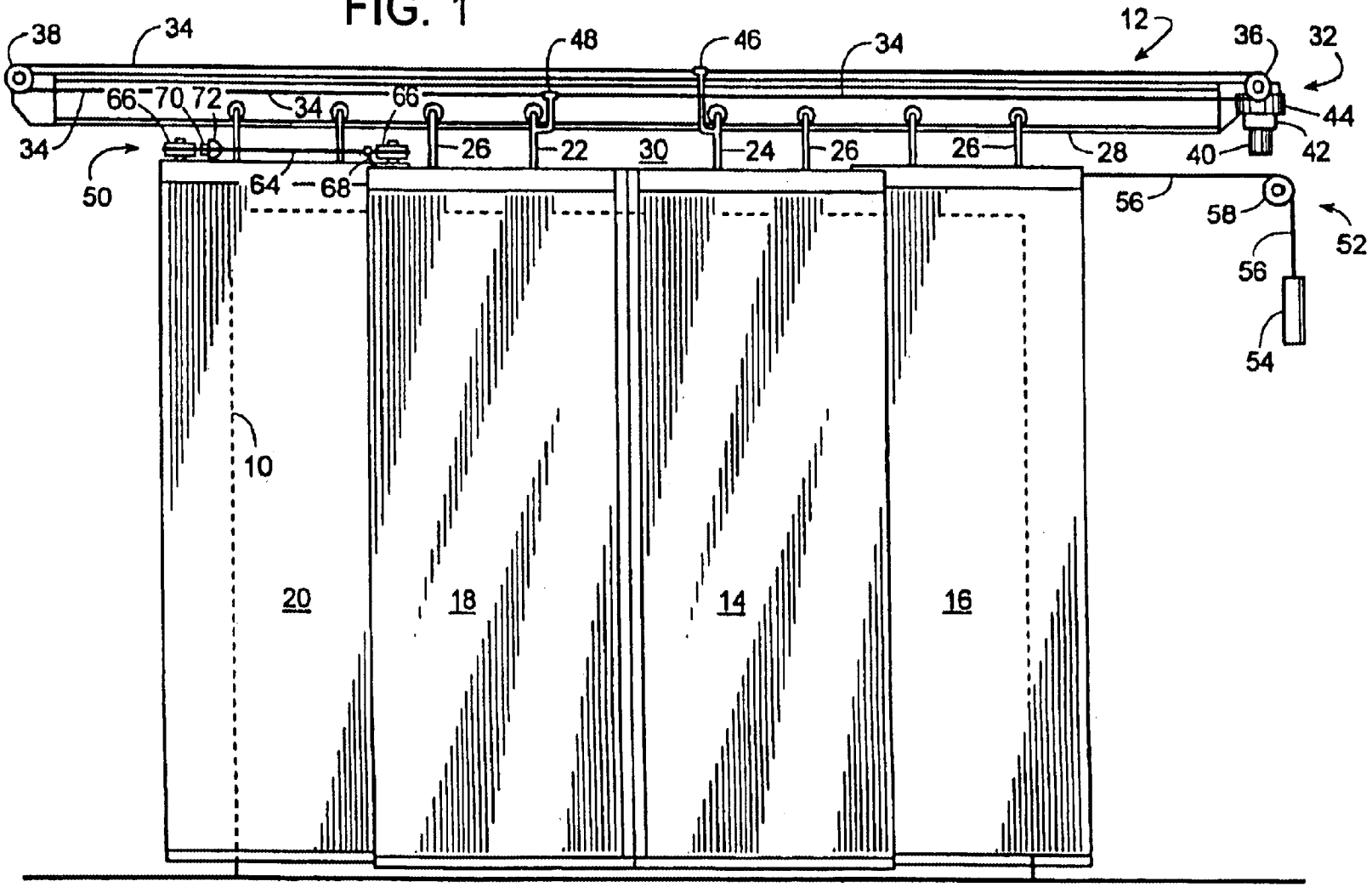
FIG. 1 is a front view of a multi-panel, bi-parting sliding door in a closed position.
Figure 2:
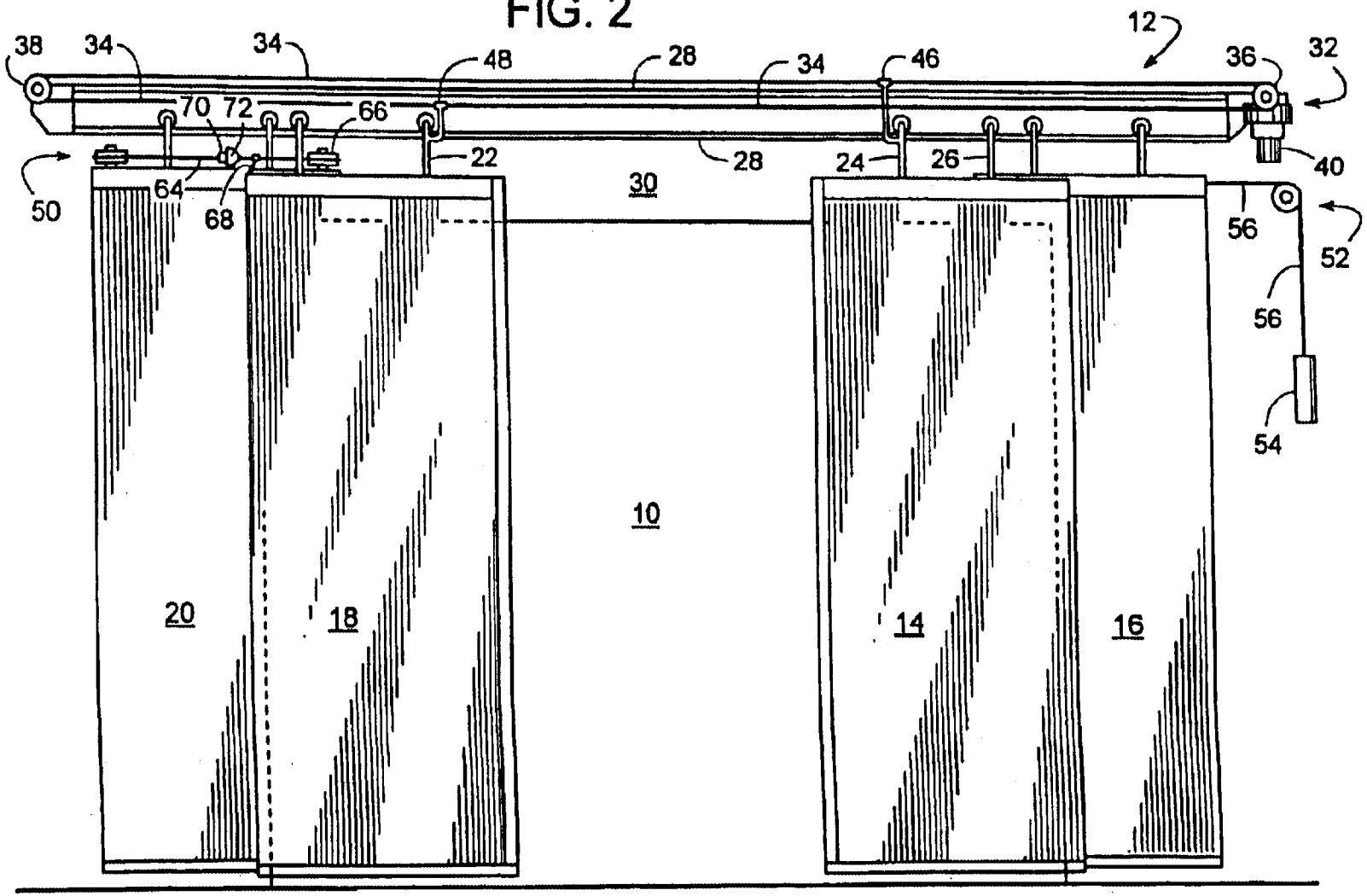
FIG. 2 is a front view of the door of FIG. 1, but with the door in a partially open position.
Figure 3:
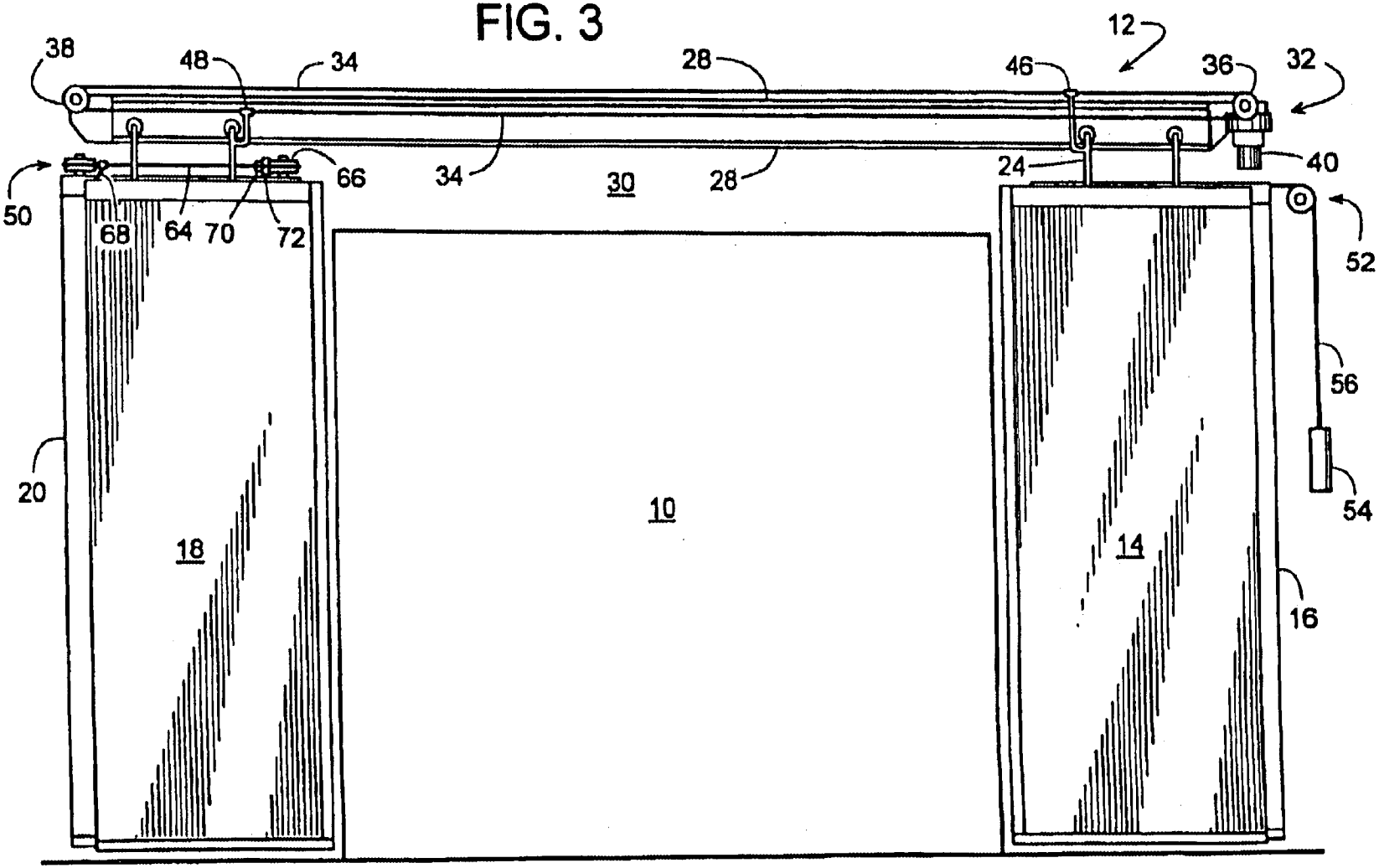
FIG. 3 is a front view of the door of FIG. 1, but with the door open.

To close off a doorway 10 leading to a room or other area of a building, a laterally-moving door such as sliding door 12 is installed adjacent the doorway, as shown FIGS. 1, 2 and 3 with door 12 being shown in a closed position, a partially open position, and a fully open position respectively. The terms, "sliding door" and "laterally-moving door" refer to those doors that open and close by virtue of a door panel that moves primarily horizontally in front of a doorway without a significant amount of pivotal motion about a vertical axis. The horizontal movement can be provided by any of a variety of actions including, but not limited to sliding and rolling. Although door 12 will be described with reference to a four-panel, bi-parting door, those of ordinary skill in the art should appreciate that the number of panels could exceed four. There could also be as few as two, as in the case of a two-panel door that operates from just one side of the doorway.

As for the illustrated embodiment, door 12 opens and closes by way of four panels 14, 16, 18 and 20 that are mounted for translation in front of doorway 10. The specific structure of the panels and their properties such as rigidity and thermal insulating properties can vary widely depending on the application; however, in this example each of the panels include a polyurethane foam core encased within a protective outer skin. Translation of the panels while inhibiting their rotation about a vertical axis is provided, in this example, by suspending each panel from two panel carriers such as sliding carriages or trolleys 22, 24 and 26 that roll along a track 28. In some embodiments, track 28 is mounted to a wall 30 and situated overhead and generally above doorway 10. Track 28 can assume a variety of configurations including, but not limited to, straight and level or slightly angled to create a slope along which the panel carriers move, thereby providing gravity assist to close the door.

To power-operate door 12, a drive unit 32 moves lead panels 14 and 18 either apart or together to respectively open or close door 12. Drive unit 32 can be any of a wide variety of known actuators for operating a sliding door. However, in one embodiment, drive unit 32 includes a cogged belt 34 disposed about two cogged sheaves 36 and 38. Sheave 36 is driven by a motor 40 through a gear reduction 42 and a clutch 44, while sheave 38 serves as an idler. One clamp 46 couples trolley 24 of panel 14 to move with an upper portion of belt 34, and another clamp 48 couples trolley 22 of panel 18 to move with a lower portion of belt 34. Thus, depending on the rotational direction that motor 40 turns sheave 36, panels 14 and 18 move together to close the door or apart to open it.

Figure 4:
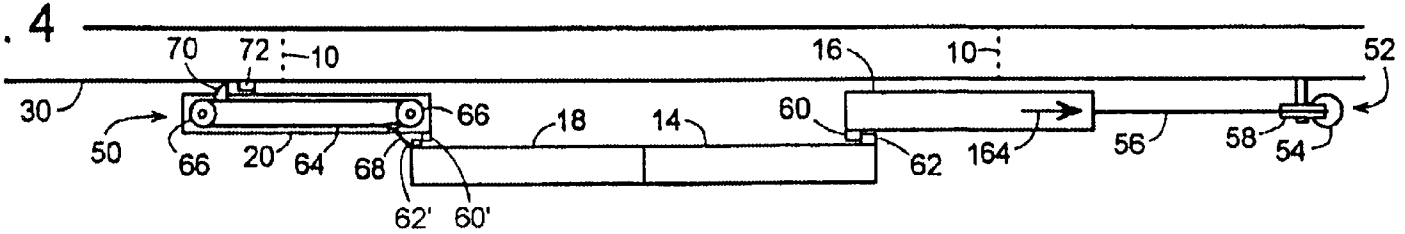
FIG. 4 is a schematic top view of FIG. 1.

To open door 12 from its closed position of FIGS. 1 and 4, drive unit 32 turns sheave 36 clockwise (as viewed looking into FIG. 1). This moves belt 34 to pull lead panels 14 and 18 apart from each other and away from the center of the doorway. The outward movement of lead panels 14 and 18 allows their respective lag panels 16 and 20 to move outward as well. An auxiliary drive mechanism 50 on the left-side of door 12 urges lag panel 20 to open to the left, while another auxiliary drive mechanism 52 on the right-side urges lag panel 16 to open to the right. Although both mechanisms 50 and 52 are shown on a single door, they are actually two alternate embodiments, where preferably only one or the other would normally be used on both sides of one door.

As for the right side the door, to move lag panel 16 to its open position in front of wall 30, drive mechanism 52 includes a hanging weight 54 that urges panel 16 to the right. Weight 54 applies tension to a cable 56 that is attached to panel 16 and strung over a sheave 58 on wall 30. The tension in cable 56 pulls a protrusion 60 (FIG. 4) extending from lag panel 16 up against, or at least towards, a similar protrusion 62 extending from lead panel 14. Thus the position of lead panel 14 limits the extent to which lag panel 16 can move to the right. As drive unit 32 moves lead panel 14 to the right, the tension in cable 56 exerts an acceleration force 164 that urges lag panel 16 to move with lead panel 14. Panels 14 and 16 move through their positions shown in FIG. 5 and come to rest as shown in FIG. 6, where door 12 is fully open. Since lag panel 16 is moved toward the open position by auxiliary drive 52, movement of panel 16 is not dependent on a jarring impact between lead panel 14 and lag panel 16. Also, the bias toward the open position of lag panel 16 provided by drive mechanism 52 ensures that protrusion 60 is firmly in contact with protrusion 62 on lead panel 14 with the door in the closed position. This accurately maintains the position of lag panel 16. If the protrusions are seals, this tighter engagement gives better sealing.

Figure 7:
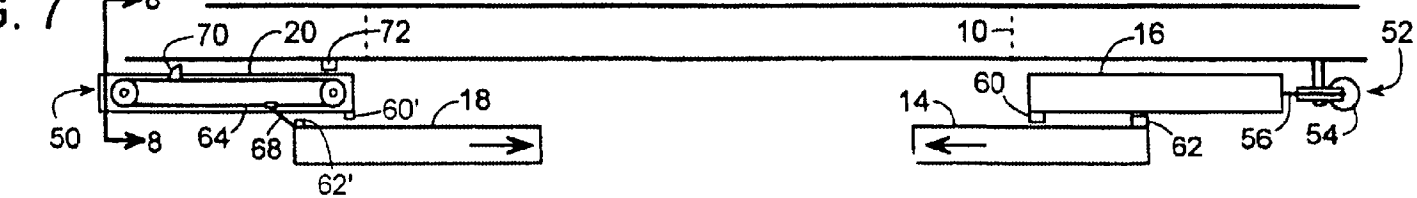
FIG. 7 is a schematic top view similar to FIG. 5, but with the door closing.

Still referring to the right side of the door, to close panels 14 and 16, drive unit 32 rotates sheave 36 counter-clockwise. This moves belt 34 to pull the right lead panel 14 toward the center of doorway 10, as shown in FIG. 7. When lead protrusion 62 engages lag protrusion 60, lead panel 14 pulls lag panel 16 with it, which in turn lifts weight 54. Drive unit 32 stops when both panels 14 and 16 reach their closed position, as shown in FIG. 4.

Figure 8:
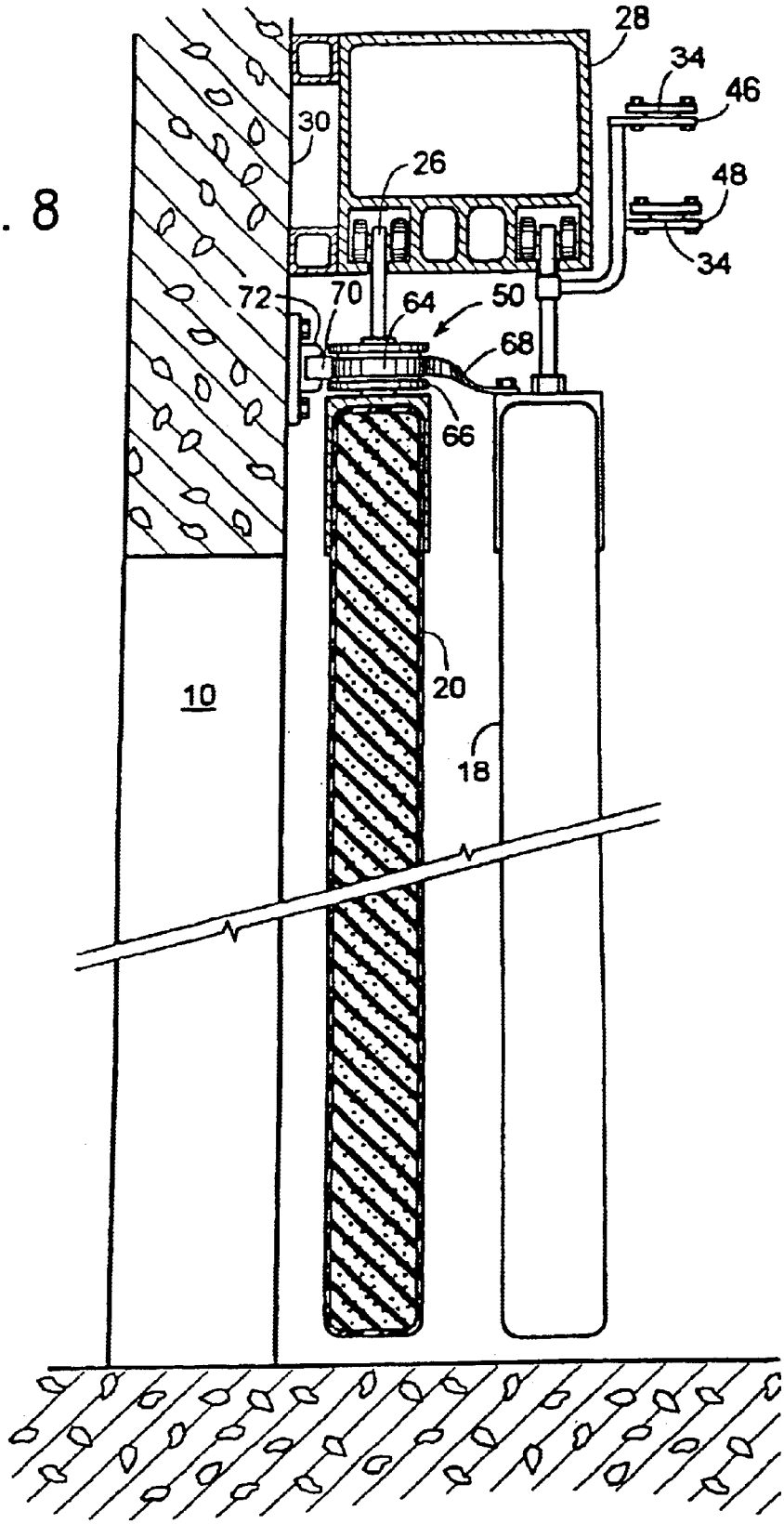
FIG. 8 is a cross-section view taken along line 8—8 of FIG. 7.

As for the left-side of door 12, to smoothly accelerate lag panel 20 to quickly move to its open position in front of wall 30 while the corresponding lead panel 18 opens, drive mechanism 50 selectively couples lag panel 20 to lead panel 18, such that the panels move independently during part of their travel, and dependently for other parts of travel. In FIG. 8, for example, drive mechanism 50 includes a flexible ring 64 such as a belt or roller chain encircling two rotatable members 66 such as a sheave, sprocket or some other type of wheel rotatably mounted to lag panel 20. A link 68 connects lead panel 18 to ring 64. A bumper 70 is attached to travel with ring 64 such that as the ring moves around wheels 66, bumper 70 engages a stop 72 that is mounted to wall 30, or to the track, which is itself mounted to the wall.

Figure 5:
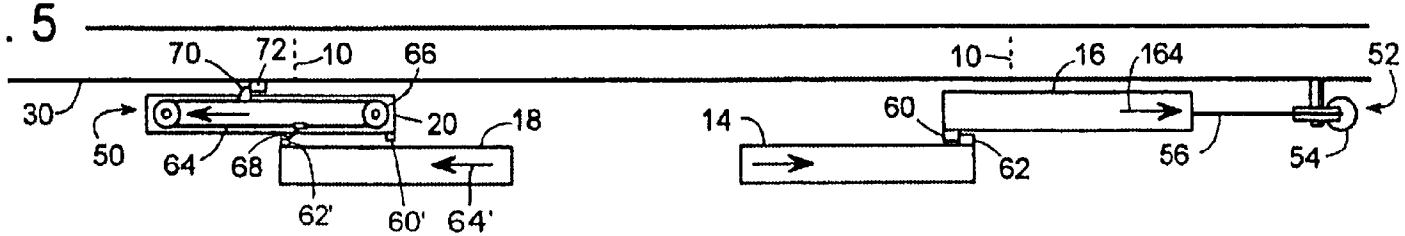
FIG. 5 is a schematic top view of FIG. 2 with the door opening.
Figure 6:
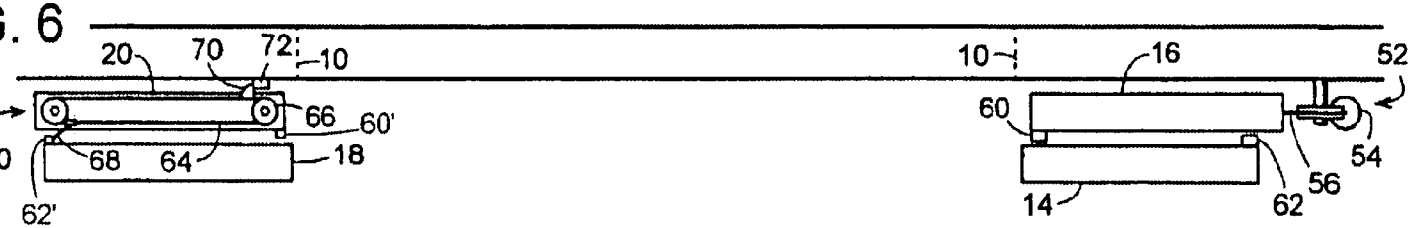
FIG. 6 is a schematic top view of FIG. 3.

As drive unit 32 begins moving the left lead panel 18 from its closed position of FIG. 4 to a partially open position of FIG. 5, link 68 may flex (depending on its flexibility) as shown. At present, however, a rigid link, such as a section of bar stock is preferred. Through link 68, lead panel 18 moving relative to lag panel 20 also moves ring 64 around rotating members 66. The movement of ring 64 moves bumper 70 up against stop 72, as shown in FIG. 5. Continued leftward movement of lead panel 18 relative to lag panel 20 causes bumper 70 to push against stop 72. This creates a reaction or acceleration force 64' that smoothly moves lag panel 20 to the left at about half the velocity of lead panel 18. Drive unit 32 stops when both panels 18 and 20 are in their open position, as shown in FIG. 6.

Figure 13:
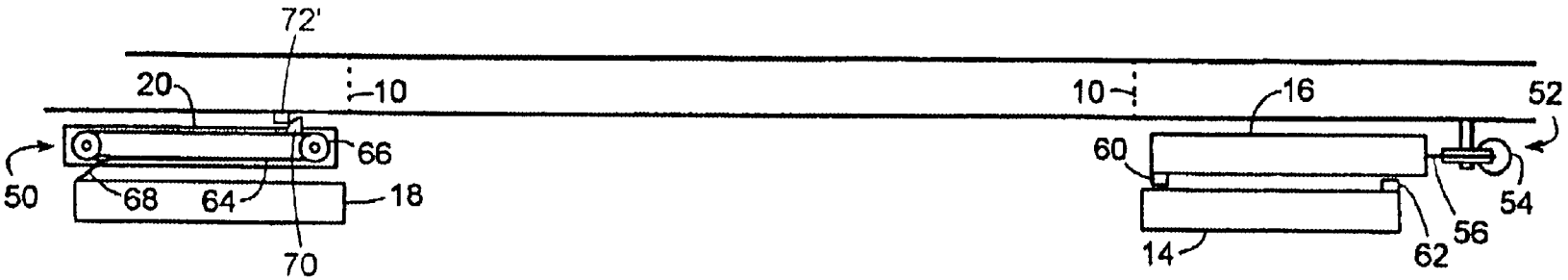
FIG. 13 is a schematic top view similar to FIG. 6, but showing a protrusion that may assist in closing a lag panel of a door.

To close the left side of door 12, drive unit 32 rotates sheave 36 counter-clockwise. This moves belt 34 to pull the left lead panel 18 toward the center of doorway 10, as shown in FIG. 7. The rightward movement of lead panel 18 relative to lag panel 20 causes link 68 to move ring 64 about rotatable members 66. This, in turn, moves bumper 70 away from stop 72, as shown in FIG. 7. As lead panel 18 continues toward the closed position, a protrusion (62') on panel 18 engages a similar protrusion (60') on lag panel 20 (similar to protrusion 62 of panel 14 engaging protrusion 60 of panel 16), thus pulling lag panel 20 closed. One of skill in the art will appreciate that drive mechanism 50 could also be used to close lag panel 20 by, for example, providing an appropriately-positioned stop such as stop 72. An example apparatus with a stop 72' that may be used to close the lag panel 20 is shown in FIG. 13, where like reference numerals are used. Other means for moving lag panel 20 to the closed position are also conceivable.

Drive mechanism 50 may thus provide panels 18 and 20 with two states of movement—a first state in which their movement is independent (from FIG. 6 to FIG. 7, for example); and a second state in which movement of one panel (e.g., panel 20) is dependent upon movement of another panel (e.g., panel 18). In this embodiment, panels 18 and 20 move at different speeds when in the second state, by virtue of the mechanics of drive 50. The current embodiment maintains a constant speed differential (2:1) in the second state.

Figure 9:
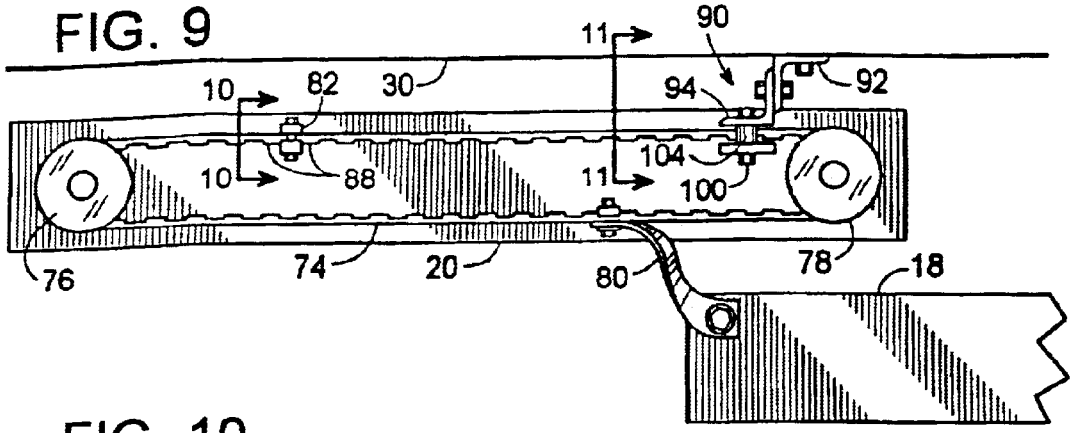
FIG. 9 is a top view of one embodiment of an auxiliary drive mechanism.
Figure 10:
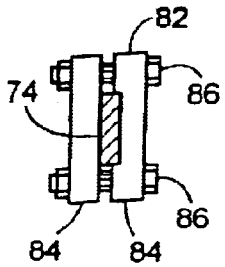
FIG. 10 is a cross-sectional view taken along line 10—10 of FIG. 9.

Although the function of drive mechanism 50 can be provided by a variety of structures, some exemplary embodiments are shown in FIGS. 9–12. In FIG. 9, for example, ring 64 is a cogged belt 74 (sometimes referred to as a timing belt), rotatable members 66 are cogged sheaves 76 and 78 that mesh with belt 74, and link 68 is a fabric strap 80, although a rigid link may be preferable. A bumper 82 comprises two pieces of bar stock 84 with two bolts 86 that clamp the bars between two cogs 88 of belt 74, as shown in FIG. 10.

Figure 11:
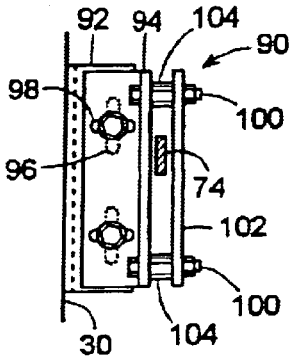
FIG. 11 is a cross-sectional view taken along line 11—11 of FIG. 9.

To provide stop 72 with vertical and horizontal adjustment as well as vertical clearance to accommodate some vertical movement of belt 74, a stop 90 is configured as shown in FIG. 11. Stop 90 comprises two angled members 92 and 94 with elongated bolt-hole slots 96 and 98 respectively. Slots 96 and 98 provide vertical and horizontal adjustment as bolts 100 extend through them to clamp members 92 and 94 together. A bar 102 is bolted across member 94 with two spacers 104 in between to provide sufficient clearance for belt 74, but being close enough to each other to serve as an effective stop for bumper 82. Spacers 104 are separated from each other to accommodate some vertical movement of belt 74, which may be caused by a lag panel traveling along an inclined track.

Drive mechanism 50 allows adjustability, in that door panels of a given width can be used to serve doorways of different widths. For example, the position of stop 90 can be adjusted. That is, if doorway 10 were narrower, stop 90 could be attached to the wall or track at a location that is further to the right than what is shown in FIG. 9. Then, as the door closes, bumper 82 would abut stop 90 later than it would otherwise. This would thus create more overlap between panels 18 and 20 when the door is closed and provide more travel of the lead panel (relative to the lag panel) toward the open position before drive 50 starts moving the lag panel. Consideration of FIGS. 4–7 is useful in visualizing this effect. The overlap would compensate for the door panels' extra width.

Figure 12:
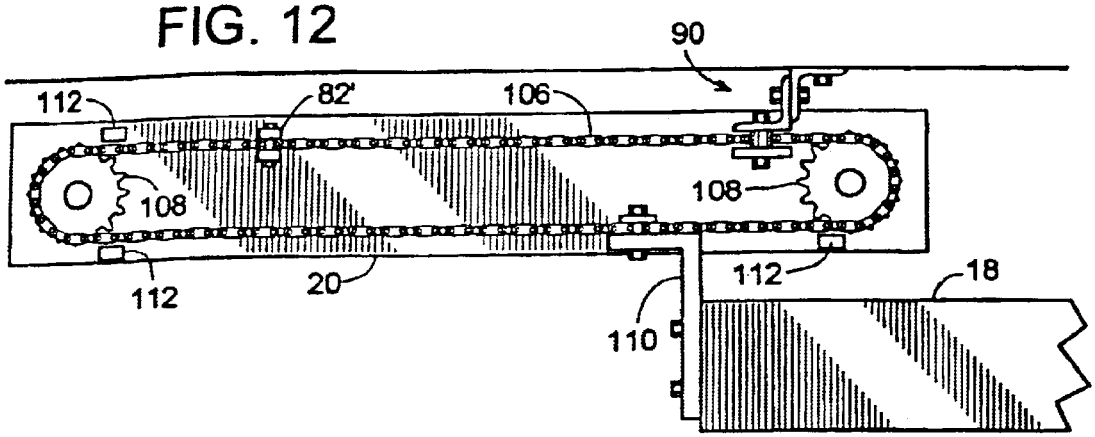
FIG. 12 is a top view of another embodiment of an auxiliary drive mechanism.

FIG. 12 shows another embodiment that is similar to that of FIGS. 9–11; however, belt 74 is replaced by a roller chain 106, sheaves 76 and 78 are replaced by sprockets 108, and strap 80 is replaced by a rigid link 110. Bumper 82' is nearly the same as bumper 82 used on belt 74, and link 110 is clamped to chain 106 in a manner similar to that of bumpers 82 and 82'. If desired, one or more travel limit stops 112 can be attached to panel 20 to help protect sprockets 108 from being struck by link 110 or bumper 82'.

Although the invention is described with reference to a preferred embodiment, it should be appreciated by those skilled in the art that various modifications are well within the scope of the invention. Therefore, the scope of the invention is to be determined by reference to the claims that follow.

What is claimed is:

1. A door adapted to at least partially cover a doorway in a wall, the door having an opened position and a closed position, comprising:

a first door panel adapted to be mounted for translation in front of the doorway;

a second door panel adapted to be mounted for translation in front of the doorway, wherein the first door panel has a first open position in front of the second door panel, the second door panel has a second open position adjacent the doorway between the first panel and the wall, and the door is in the opened position when the first door panel and the second door panel are in the first open position and the second open position respectively, the first and second door panels respectively having a first closed position and a second closed position relative to the doorway and being arranged to telescope to position the door in the opened or closed position;

a main drive mechanism providing power for driving the first panel between the first open position and the first closed position; and an auxiliary drive mechanism coupling the first door panel and the second door panel, the auxiliary drive mechanism using the power provided by the main drive mechanism to drive the second door panel such that the first and second door panels have a first state of movement wherein movement of the first door panel is independent of movement of the second door panel, and the first and second door panels have a second state of movement wherein movement of the second door panel is dependent upon movement of the first door panel, wherein upon movement of the first door panel away from its closed position, the auxiliary drive mechanism urges the second door panel to move toward the second open position before the first door panel reaches the first open position.

2. The door of claim 1, wherein the auxiliary drive mechanism includes a flexible ring encircling two rotatable members coupled to the second door panel.

3. The door of claim 2, further comprising a link that couples the flexible ring to the first door panel.

4. The door of claim 3, wherein the link is pliable.

5. The door of claim 2, further comprising a stop adapted to be coupled at a fixed position relative to the wall to limit an extent to which the flexible ring may move relative to the wall.

6. The door of claim 5, further comprising a bumper attached to the flexible ring and positioned to alternately engage and disengage the stop.

7. The door of claim 2, wherein the flexible ring is a cogged belt and at least one of the two rotatable members is a cogged sheave.

8. The door of claim 2, wherein the flexible ring is a chain and at least one of the two rotatable members is a sprocket.

9. The door of claim 1, further comprising an opposite door panel substantially coplanar with the first door panel such that the first door panel and the opposite door panel move apart to open the door and move towards each other to close the door, wherein the first door panel abuts the opposite door panel upon closing the door.

10. The door of claim 1, wherein the first state of movement occurs when the first door panel begins to move away from the first closed position, wherein the second state of movement occurs when the second door panel begins to move away from the second closed position, wherein the first and second door panels have a third state of movement as the first door panel begins to move away from the first opened position wherein movement of the first door panel is independent of movement of the second door panel, and the first and second door panels have a fourth state of movement when the second door panel begins to move away from the second opened position wherein movement of the second door panel is dependent upon movement of the first door panel.

11. A door adapted to at least partially cover a doorway in a wall, the door having an opened position and a closed position, comprising:

a first door panel adapted to be mounted for translation in front of the doorway;

a second door panel adapted to be mounted for translation in front of the doorway, wherein the first door panel has a first open position in front of the second door panel, the second door panel has a second open position adjacent the doorway between the first panel and the wall, and the door is in the opened position when the first door panel and the second door panel are in the first open position and the second open position respectively, the first and second door panels respectively having a first closed position and a second closed position relative to the doorway and being arranged to telescope to position the door in the opened or closed position;

a main drive mechanism providing power for driving the first panel from the first open position to the first closed position; and an auxiliary drive mechanism coupling the first door panel and the second door panel, the auxiliary drive mechanism using the power provided by the main drive mechanism to drive the second door panel such that, when closing the door, the first and second door panels have a first state of movement wherein movement of the first door panel is independent of movement of the second door panel, and the first and second door panels have a second state of movement wherein movement of the second door panel is dependent upon movement of the first door panel, wherein upon movement of the first door panel away from the first open position, the auxiliary drive mechanism urges the second door panel to move toward the second closed position before the first door panel reaches the first closed position.

12. The door of claim 11, wherein the auxiliary drive mechanism includes a flexible ring encircling two rotatable members coupled to the second door panel.

13. The door of claim 11, wherein the first state of movement occurs when the first door panel begins to move away from the first opened position, wherein the second state of movement occurs when the second door panel begins to move away from the second opened position, wherein the first and second door panels have a third state of movement as the first door panel begins to move away from the first closed position wherein movement of the first door panel is dependent on movement of the second door panel, and the first and second door panels have a fourth state of movement after the second door panel reaches the second opened position wherein movement of the first door panel is independent of movement of the second door panel.

14. A method of operating a door adapted to at least partially cover a doorway in a wall, the door having an opened position and a closed position, comprising:

(1) opening the door by:

(a) actuating a main drive mechanism to initially translate a first door panel toward a first open position in front of a second door panel while inhibiting the first door panel from rotating about a vertical axis and without moving the second door panel; and (b) using power from the main drive mechanism to actuate an auxiliary drive mechanism which couples the first door panel and the second door panel to thereby translate the second door panel toward a second open position in front of the wall; and, (2) closing the door by:

(a) actuating the main drive mechanism to initially translate the first door panel toward a first closed position without moving the second door panel; and (b) using power of the main drive mechanism to actuate the auxiliary drive mechanism to thereby translate the second door panel toward a second closed position.

15. The method of claim 14, wherein the auxiliary drive comprises a flexible ring disposed about two rotatable members that are coupled to the second door panel, and wherein the steps of using power of the main drive mechanism to actuate the auxiliary drive mechanism include moving the flexible ring about the rotatable member.

16. The method of claim 15, wherein the auxiliary drive further comprises a bumper attached to the flexible ring, and wherein the steps of using power of the main drive mechanism to actuate the auxiliary drive mechanism include moving the bumper at least one of into and out of engagement with a stop coupled to the wall.

17. A door adapted to at least partially cover a doorway in a wall, comprising:

a first door panel adapted to be mounted for translation in front of the doorway;

a second door panel adapted to be mounted for translation in front of the doorway, wherein the first door panel has a first open position in front of the second door panel, the second door panel has a second open position adjacent the doorway between the first panel and the wall, and the door is open when the first door panel and the second door panel are in the first open position and the second open position respectively, the panels respectively having a first closed position and a second closed position relative to the doorway;

a main drive mechanism providing power for driving the first door panel from the first opened position to the first closed position; and an auxiliary drive mechanism coupling the first door panel and the second door panel and powered by the power provided by the main drive mechanism to provide uncoupled movement of the first and second panels during a first portion of the movement of the second door panel from the second opened position to the second closed position, wherein the movement of the second door panel is coupled with the movement of the first door panel during a second portion of the movement of the second door panel from the second opened position to the second closed position.

18. The door of claim 17, wherein the door has a first opening phase, a second opening phase occurring after the first opening phase when moving the door from the closed to the opened position, a first closing phase and a second closing phase occurring after the first closing phase when moving the door from the opened to the closed position, wherein the first door panel moves independent of the second door panel during both the first opening phase and the first closing phase, and the second door panel is moved by movement of the first door panel during both the second opening phase and the second closing phase.

19. A door adapted to at least partially cover a doorway in a wall, comprising:

a first door panel adapted to be mounted for translation in front of the doorway;

a second door panel adapted to be mounted for translation in front of the doorway, wherein the first door panel has a first open position in front of the second door panel, the second door panel has a second open position adjacent the doorway between the first panel and the wall, and the door is open when the first door panel and the second door panel are in the first open position and the second open position respectively, the first and second panels respectively having a first closed position and a second closed position relative to the doorway;

a main drive mechanism to drive the first door panel from the first open position to the first closed position;

a hanging weight coupled to urge the second door panel to the second open position; and interfering protrusions provided on the first and second door panel arranged to move the second door panel toward the closed position as the first door panel moves to the first closed position under the influence of the main drive mechanism.

20. A door adapted to at least partially cover a doorway in a wall, the door having an opened position and a closed position, comprising:

a first door panel adapted to be mounted for translation in front of the doorway;

a second door panel adapted to be mounted for translation in front of the doorway, wherein the first door panel has a first open position in front of the second door panel, the second door panel has a second open position adjacent the doorway between the first panel and the wall, and the door is in the open position when the first door panel and the second door panel are in the first open position and the second open position respectively, the first and second door panels respectively having a first closed position and a second closed position relative to the doorway;

a main drive mechanism to provide power to drive the first door panel from the first open position to the first closed position; and an auxiliary drive mechanism coupling power from the main drive mechanism to the second door panel, wherein the door has a first opening phase, a second opening phase occurring after the first opening phase when moving the door from the closed to the opened position, a first closing phase and a second closing phase occurring after the first closing phase when moving the door from the opened to the closed position, wherein the first door panel moves independent of the second door panel during both the first opening phase and the first closing phase, and the second door panel is moved by the auxiliary drive mechanism during both the second opening phase and the second closing phase.

21. A door adapted to at least partially cover a doorway in a wall, the door having an opened position and a closed position, comprising:

a first door panel adapted to be mounted for translation in front of the doorway;

a second door panel adapted to be mounted for translation in front of the doorway, wherein the first door panel has a first open position in front of the second door panel, the second door panel has a second open position adjacent the doorway between the first panel and the wall, and the door is in the opened position when the first door panel and the second door panel are in the first open position and the second open position respectively, the first and second door panels respectively having a first closed position and a second closed position relative to the doorway;

a main drive mechanism to provide power to move the first door panel from the first open position to the first closed position; and an auxiliary drive mechanism coupling power from the main drive mechanism to the second door panel, wherein the door has a first opening phase, a second opening phase occurring after the first opening phase when moving the door from the closed to the opened position, a first closing phase and a second closing phase occurring after the first closing phase when moving the door from the opened to the closed position, wherein the first door panel moves independent of the second door panel during both the second opening phase and the first closing phase, and the second door panel is moved by the auxiliary drive mechanism during the second closing phase.

22. The door of claim 1, further comprising interfering protrusions provided on the first and second door panel.

23. The door of claim 11, further comprising interfering protrusions provided on the first and second door panel.

24. The door of claim 17, further comprising interfering protrusions provided on the first and second door panel.

* * * * *